US005179793A

United States Patent [19]

Rohr

[11] Patent Number: 5,179,793

[45] Date of Patent: Jan. 19, 1993

[54] FLOATING DREDGER

[76] Inventor: Wolfgang Rohr, Zeppelinstrasse 16, 6720 Speyer, Fed. Rep. of Germany

[21] Appl. No.: 596,967

[22] Filed: Oct. 15, 1990

[30] Foreign Application Priority Data

Nov. 9, 1989 [DE] Fed. Rep. of Germany ..... 3937317

[51] Int. Cl.[5] ..... E02F 3/47

[52] U.S. Cl. ..... 37/71; 414/142.9; 37/54

[58] Field of Search ..... 37/71, 54, 183 R, 187, 37/115, 135; 414/142.9, 137.7; 294/68.23; 254/274, 900

[56] References Cited

U.S. PATENT DOCUMENTS

| | | | |
|---|---|---|---|
| 3,748,760 | 7/1973 | Schnell | 37/71 |
| 3,949,498 | 4/1976 | Iwata et al. | 37/71 |
| 3,967,394 | 7/1976 | Kelley et al. | 37/DIG. 1 |
| 4,187,625 | 2/1980 | Duval | 37/71 |
| 4,804,095 | 2/1989 | Rohr et al. | 37/71 |

FOREIGN PATENT DOCUMENTS

| | | | |
|---|---|---|---|
| 3116287 | 12/1982 | Fed. Rep. of Germany | 37/71 |
| 3536472 | 4/1987 | Fed. Rep. of Germany | 37/71 |
| 3616287 | 11/1987 | Fed. Rep. of Germany | 37/71 |
| 35926 | 2/1978 | Japan | 37/71 |
| 65641 | 5/1980 | Japan | 37/183 R |

*Primary Examiner*—Randolph A. Reese
*Assistant Examiner*—Spencer Warnick
*Attorney, Agent, or Firm*—Kinzer, Plyer, Dorn, McEachran & Jambor

[57] ABSTRACT

The floating dredger is provided with a floating body and a framework 1 on which a drive for driving pulleys 2,3,4 is mounted. Over the driving pulley 2 a hoisting rope 5 is put; on both sides of the pulley the grippers 6,7 are suspended, by means of rope pulleys 8. Each of the hoisting rope 5 ends is fastened to a compensating winch 9,10 which provides for the rope to be compensated for varying dredging depths.

4 Claims, 15 Drawing Sheets

Figure 1:
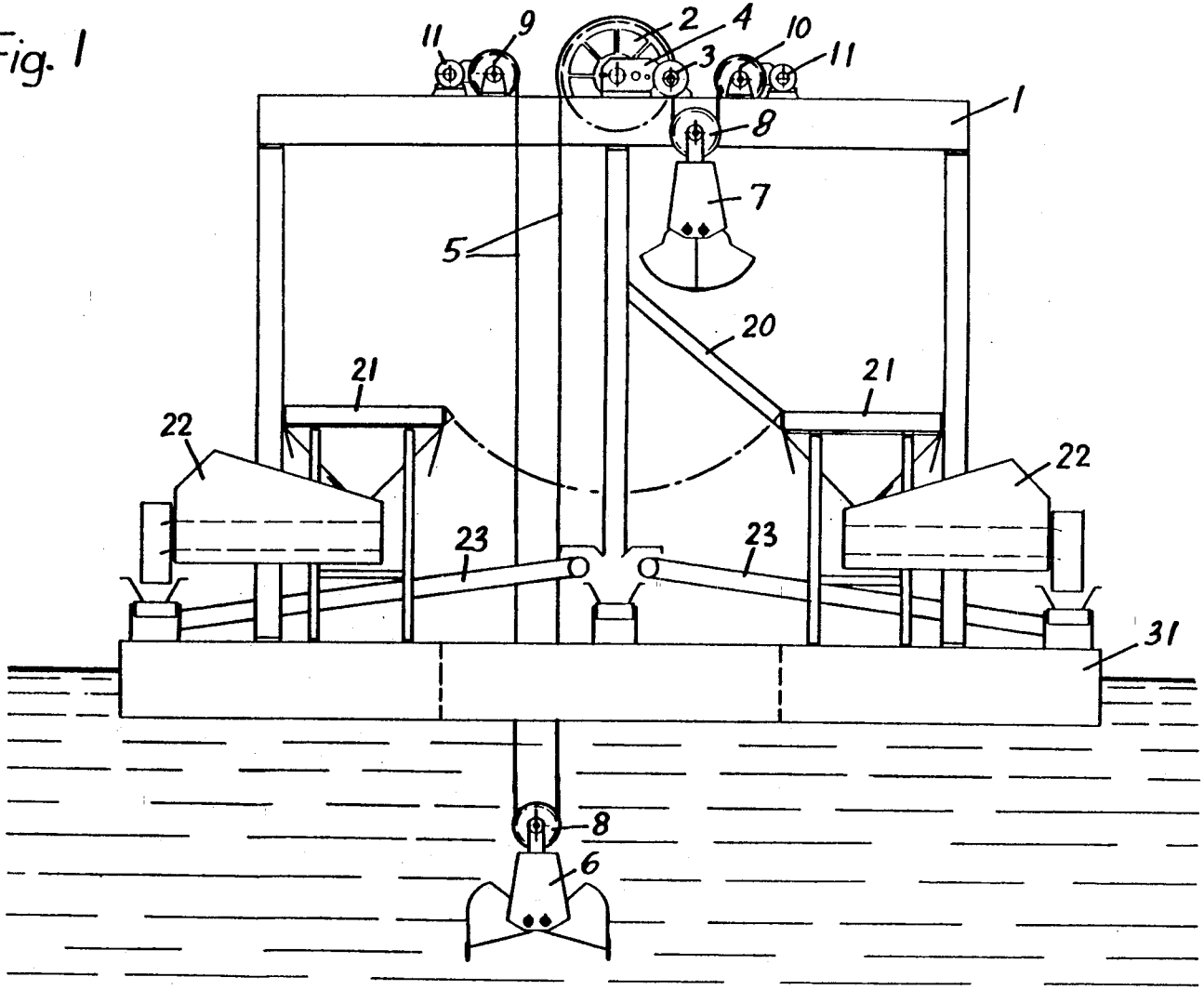

1
2
3
4
5
6
7
8
8
9
10
11
11
13
14

2
3
4
5
6
7
8
8
9
10
11
11
13
14
1

11
9
16
2
3
10
11
1
13
8
4
6
5
15
14
8
7

11
9
2
3
10
11
17
1
4
13
8
18
19
7
5
8
6
14

1
2
3
4
5
6
7
8
8
9
10
11
11
13
14
17
18
19

FLOATING DREDGER

The invention concerns a dredger with a single floating body that has a framework featuring a hoisting unit that activates two clam-shell grippers by means of a characteristic opening and closing mechanism, e.g. motorized hydraulic grippers moving in opposite directions.

There are floating dredgers known in which the gripper's own weight is eliminated by means of counter-balances, this being however disadvantageous because the counter-balance has to be moved mechanically up and down. Furthermore, the movement of counter-balance does not increase the elevating capacity.

There are also dredgers known (DE 36 16 287 A1) in which two grippers are driven countercurrently, being lowered and lifted. Those grippers are run by mechanically coupled hoisting units which, however, are not functional at different dredging depths when the compensation of dead weight in sub-range steps is not feasible. This means that drive units must be designed in the usual way.

Originating from the device of the type shown in DE 31 16 287 A1, the invention has the objective to design the floating dredger in a manner that makes it possible to compensate the varying dredging depth caused by an inclination of the ground and, possibly, sliding material, the gripper's own weight not being considered.

This task can be resolved by the invention thereby that:

- as a hoisting unit, at least one driving pulley is provided and that
- the hoisting rope is lead over the driving pulley and the rope pulleys provided on the grippers and that,
- the ends of the hoisting rope are fastened to the compensating winches that control rope's length for varying dredging depths.

One advantageous form of execution (arrangement) provides that the gripper's upper end point (upper limit position) is controlled by a limit switch or light barriers.

Furthermore, it is advantageous to control the gripper's lower end point (lower limit position) through initiators, weigh cells, pressure cells, wire strain gauges, standstill motors, or similar appliances.

It is furthermore proposed that the hoisting rope is lead over guide blocks to increase the distances between the grippers. One advantageous execution form proposes that the driving pulley is mounted on the floating body while the compensating winches and the guide blocks are mounted on the framework.

Another arrangement proposes that a moving chute or a bunker carriage is moved under the grippers in their upper end positions.

The advantage of this invention consists in eliminating the gripper's own weight through employment of coupled grippers moving in opposite directions, so that a higher output can be achieved. To operate two grippers one needs only as much power as is necessary for one gripper. Moreover, eliminating the dead load increases energy savings. Instead of expensive hoisting units that have been employed hitherto, a simple drive via one, or more, driving pulleys is possible. Using driving pulleys of this kind reduces considerably rope wear. Through the invention, simple means are only needed to make an adjustment to varying dredging depths.

The invention will be more closely explained in the following descriptions of the examples of operations presented in the drawings.

The drawings show:

FIG. 1 an elevation of the dredger with the drive for the grippers

Figure 2:
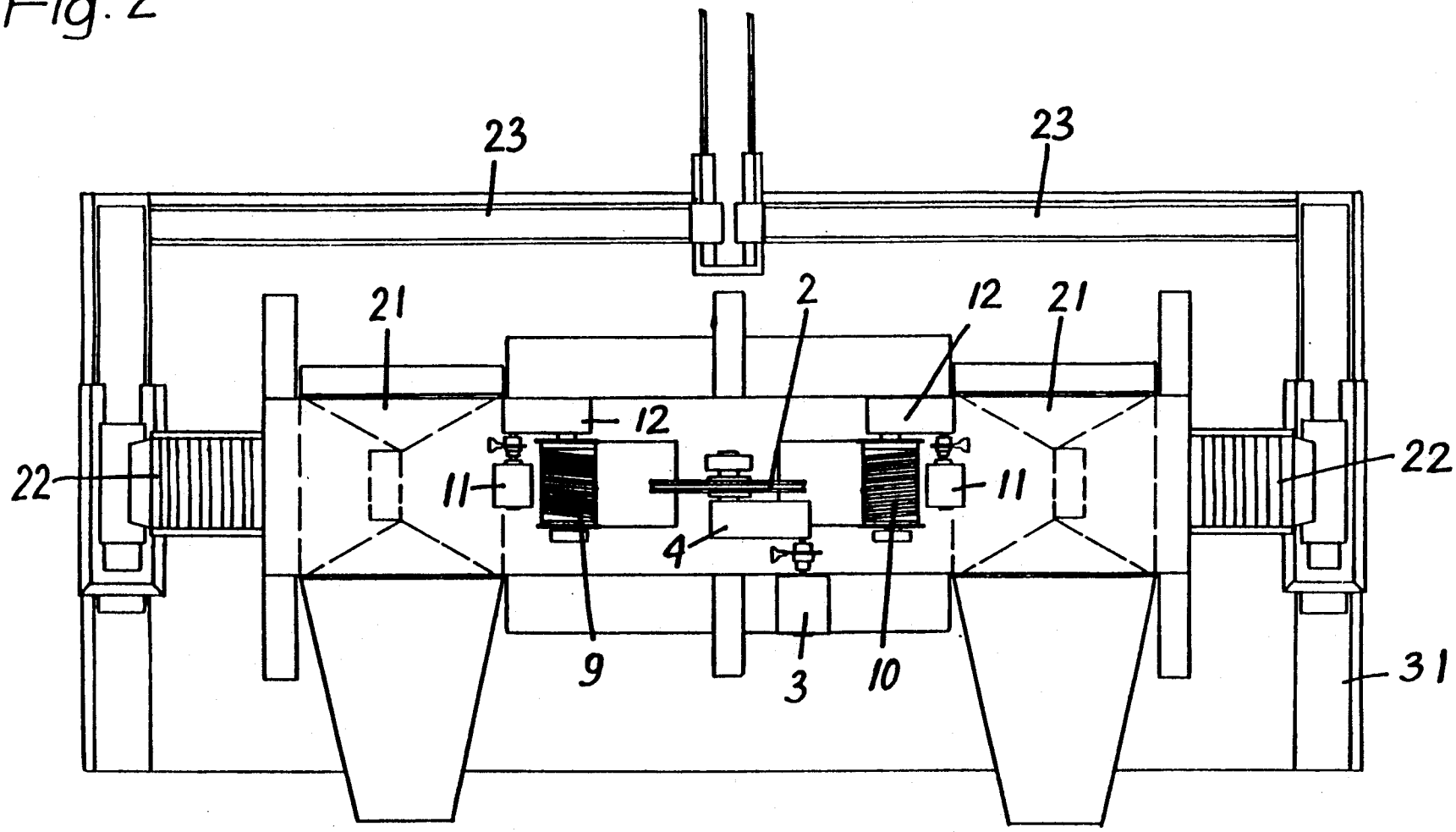

FIG. 2 a topview of the dredger shown in FIG. 1

Figure 3:
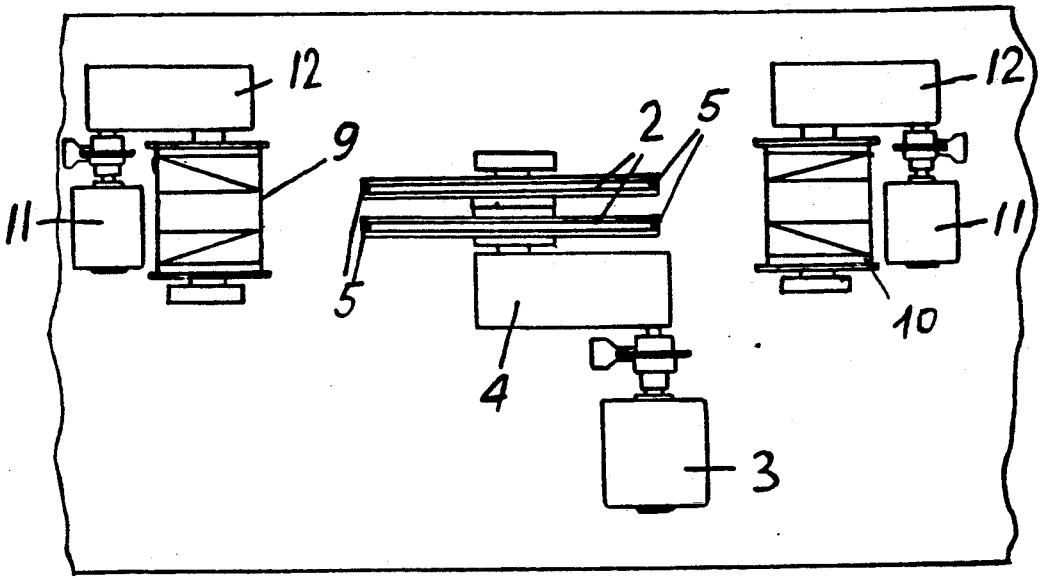

FIG. 3 a detail topview of the drive

Figure 4:
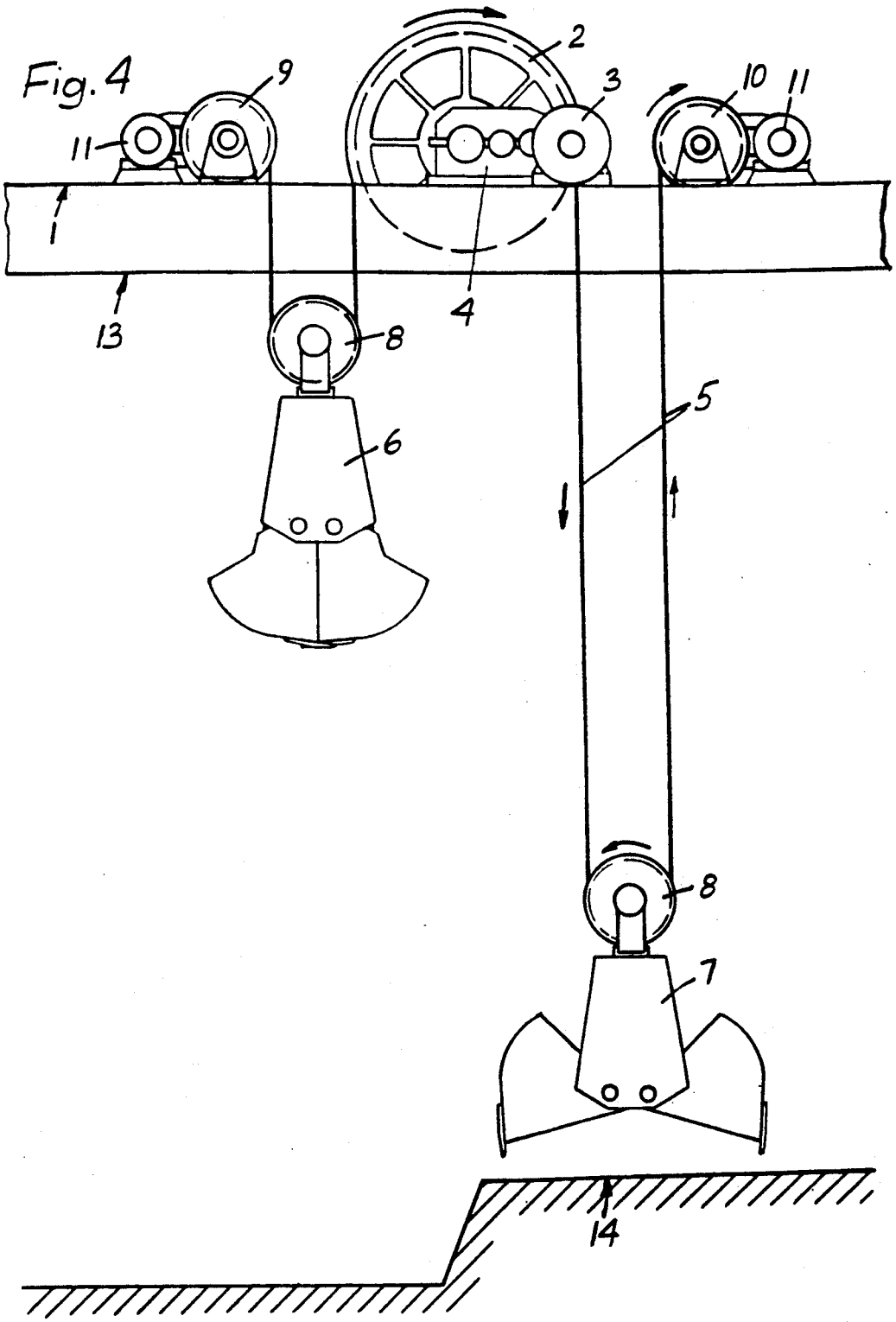
Figure 5:
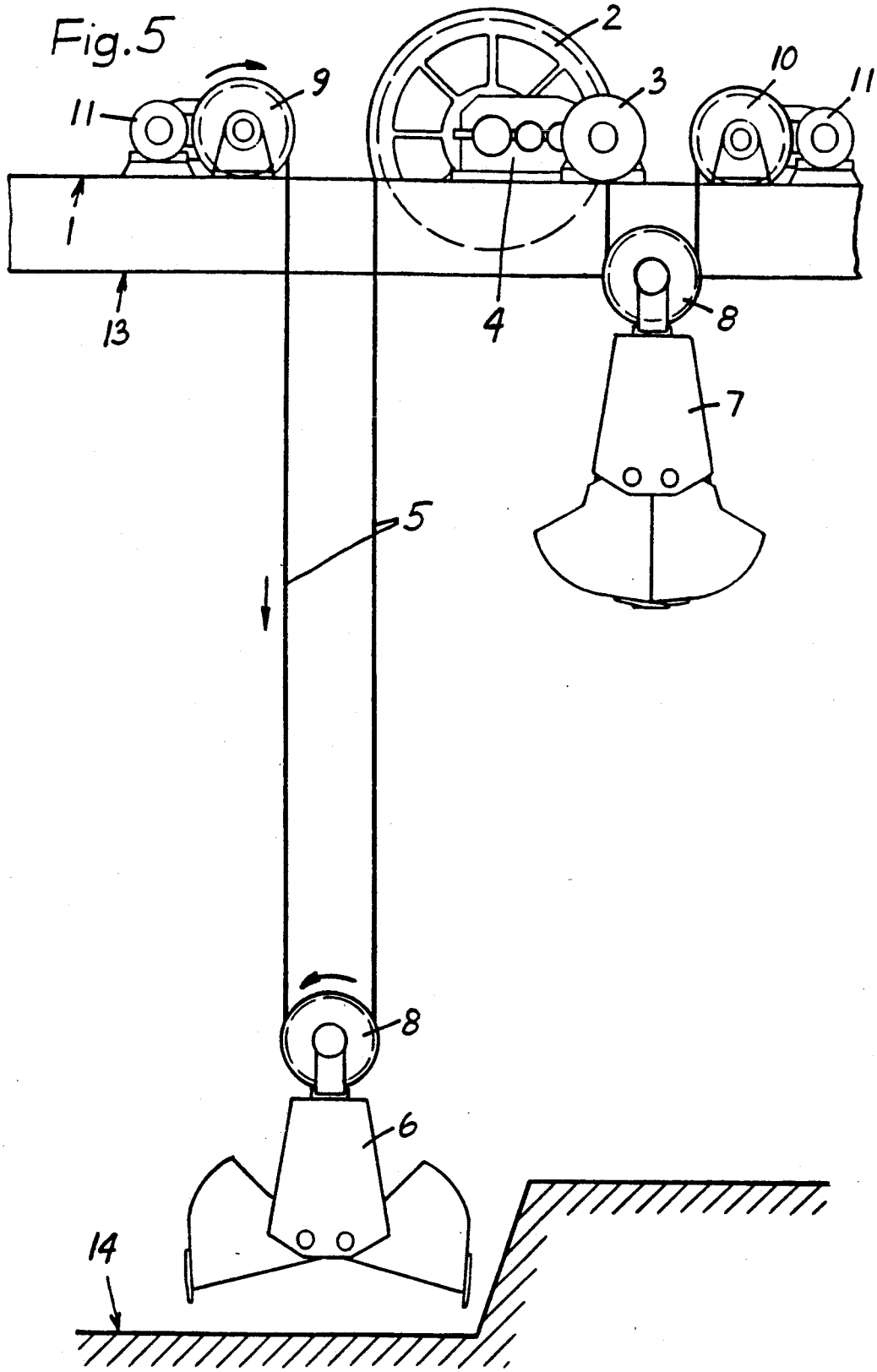
Figure 6:
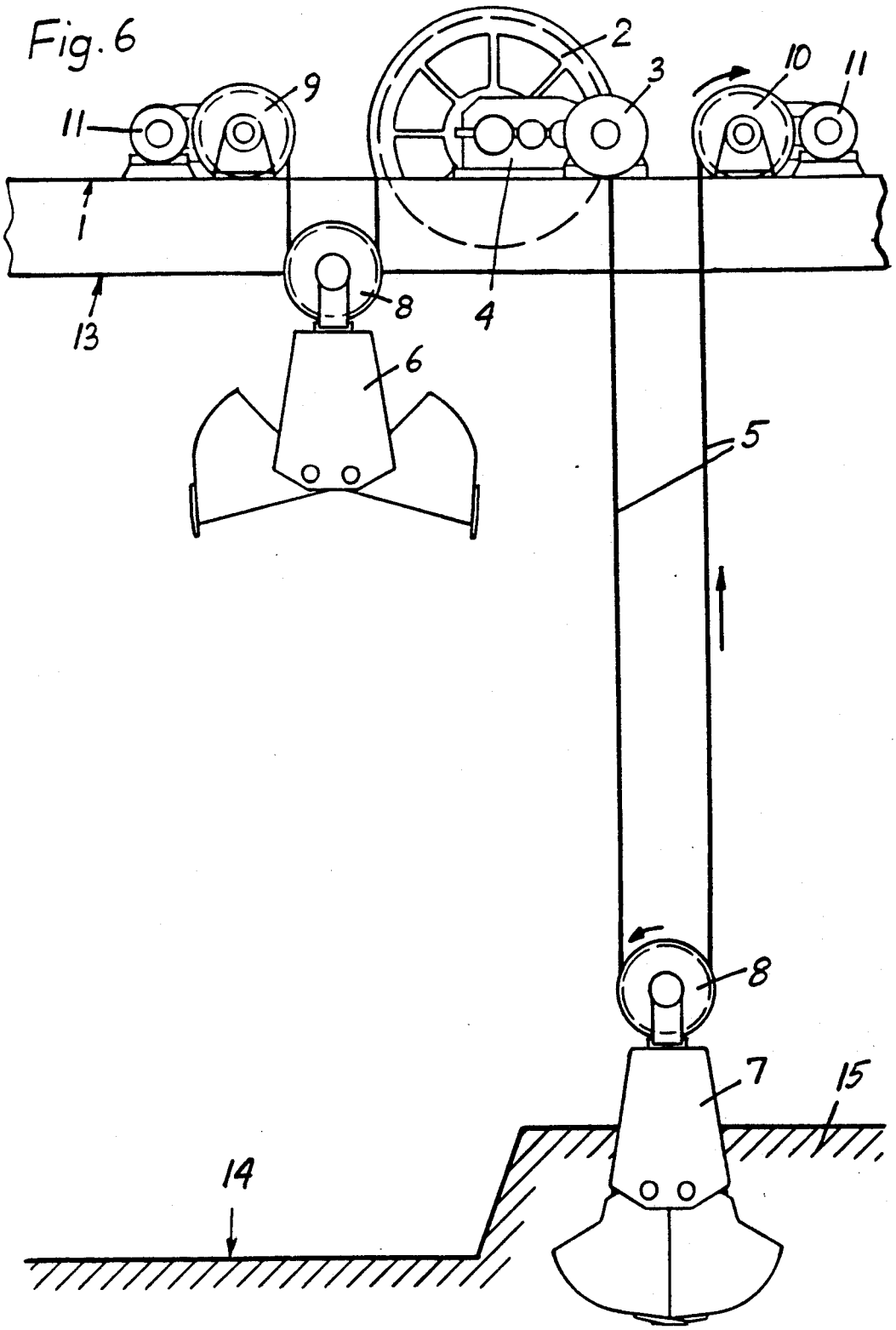
Figure 7:
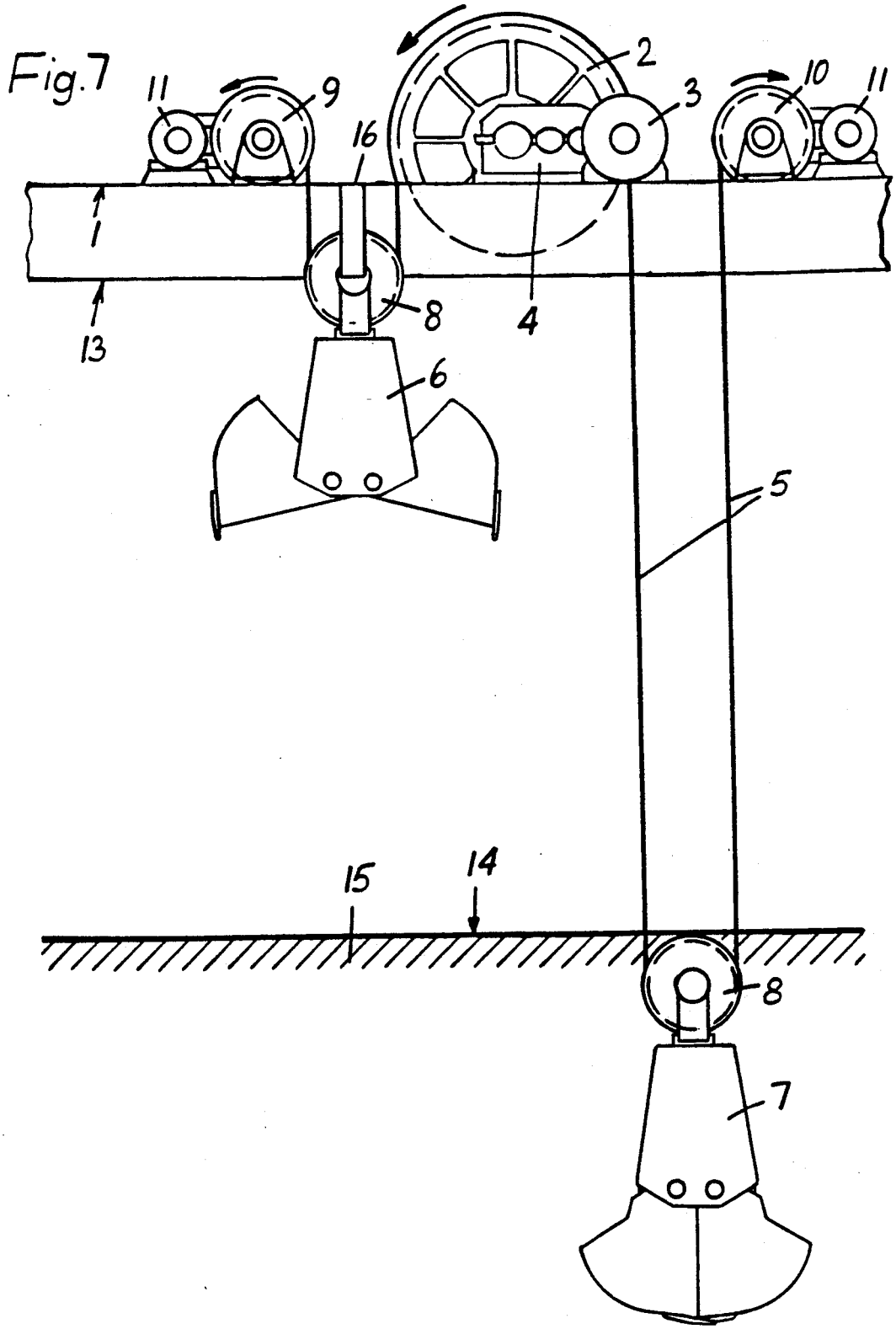
Figure 8:
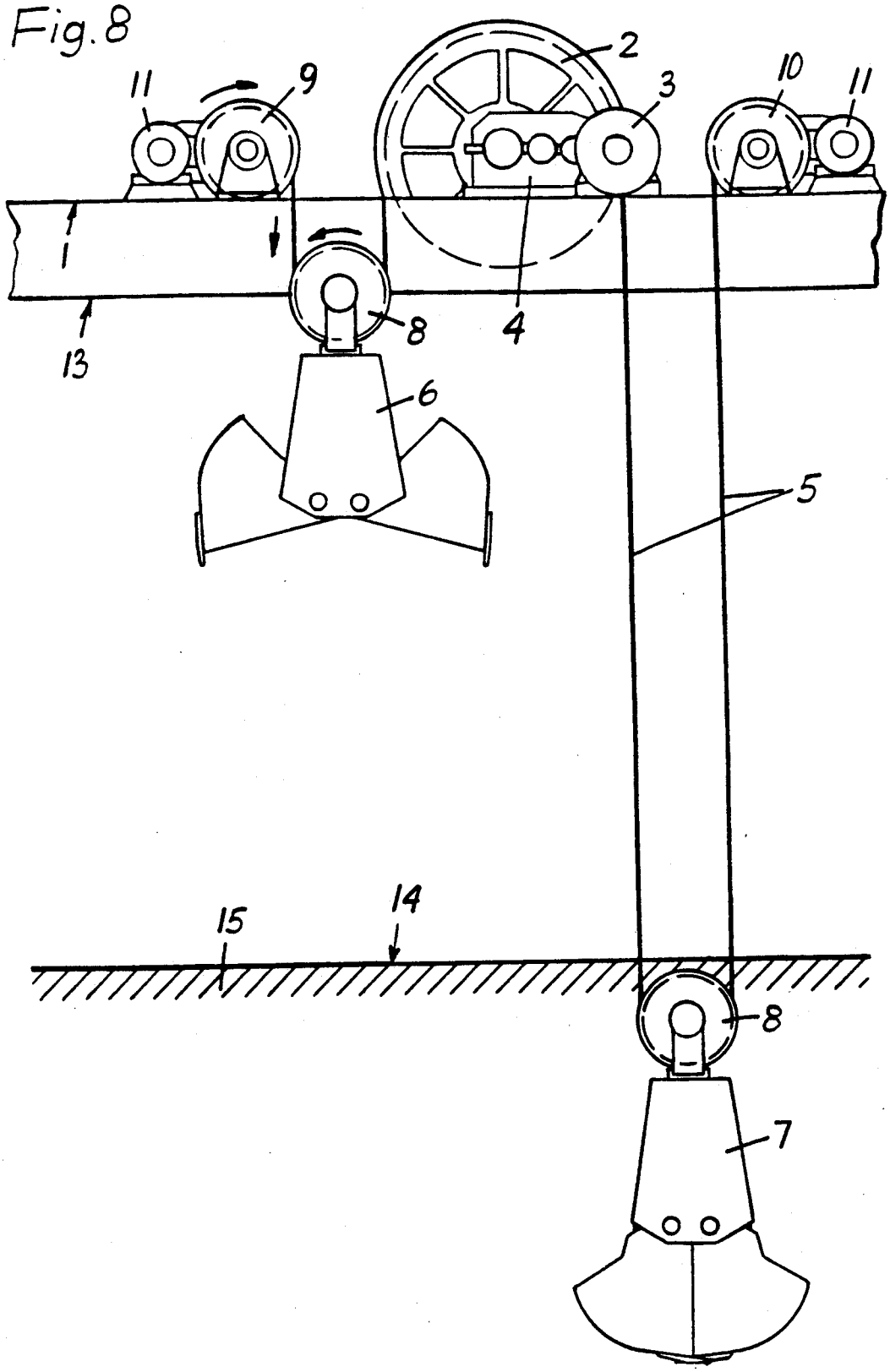
Figure 9:
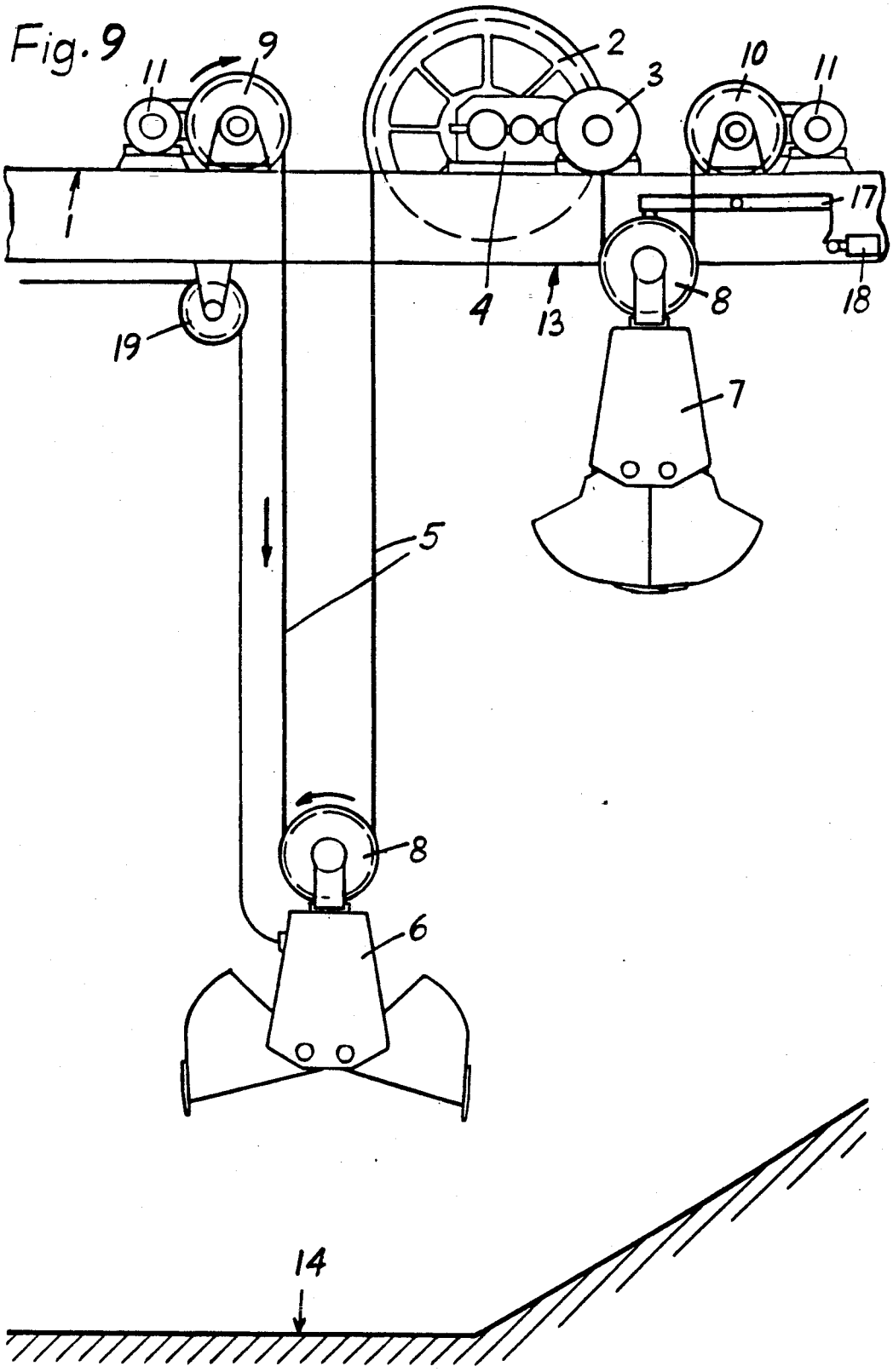
Figure 10:
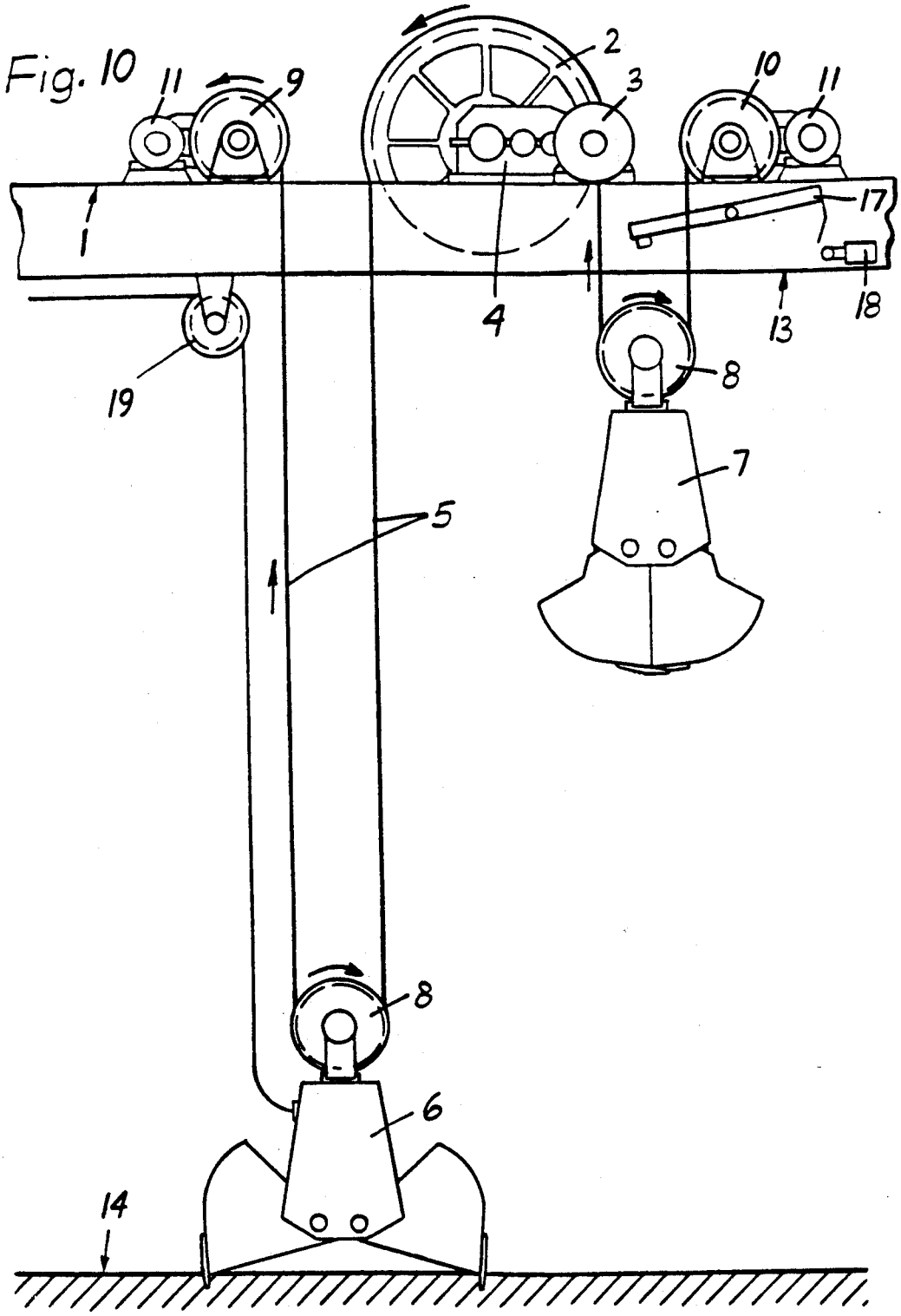
Figure 11:
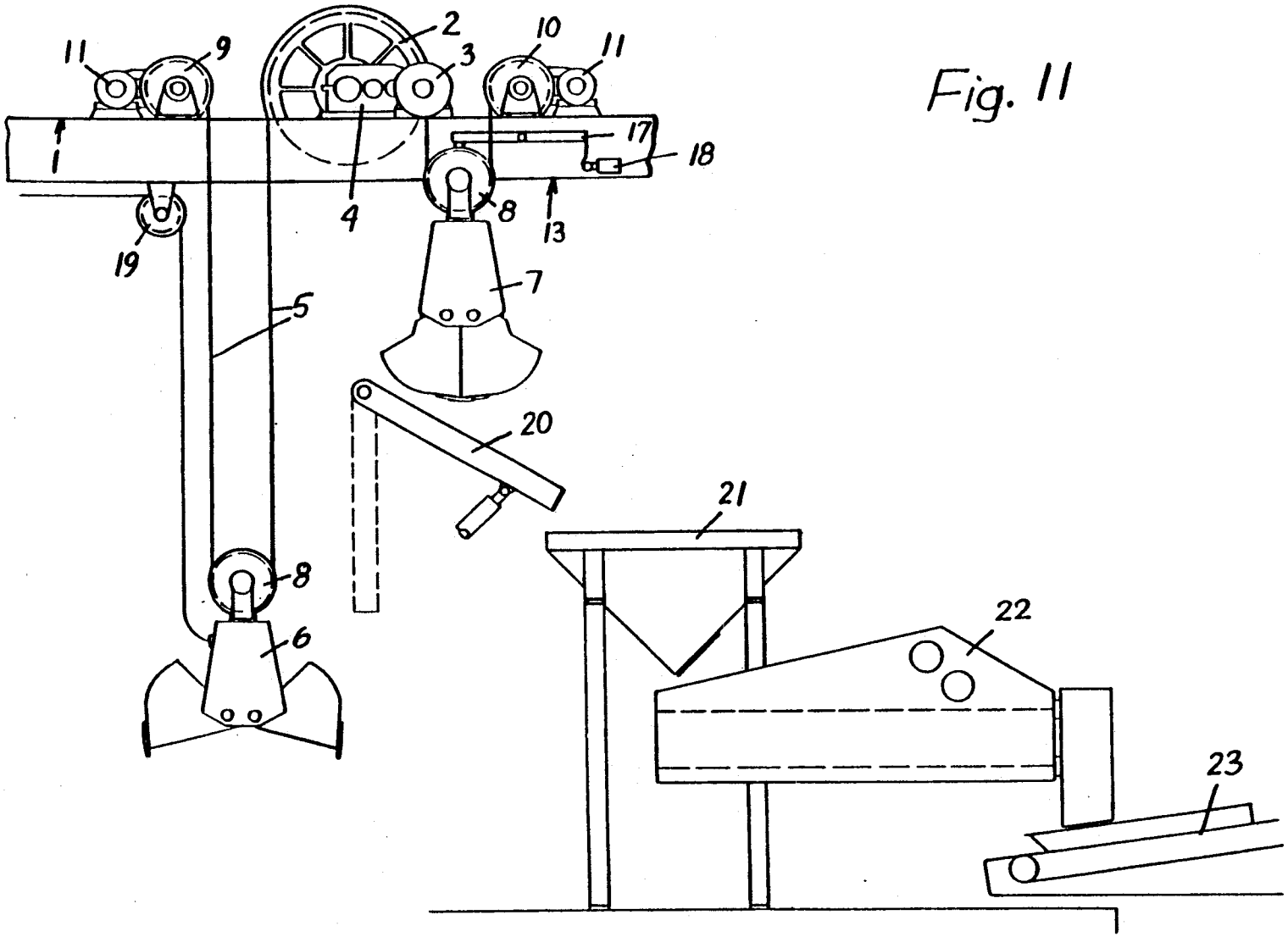
Figure 12:
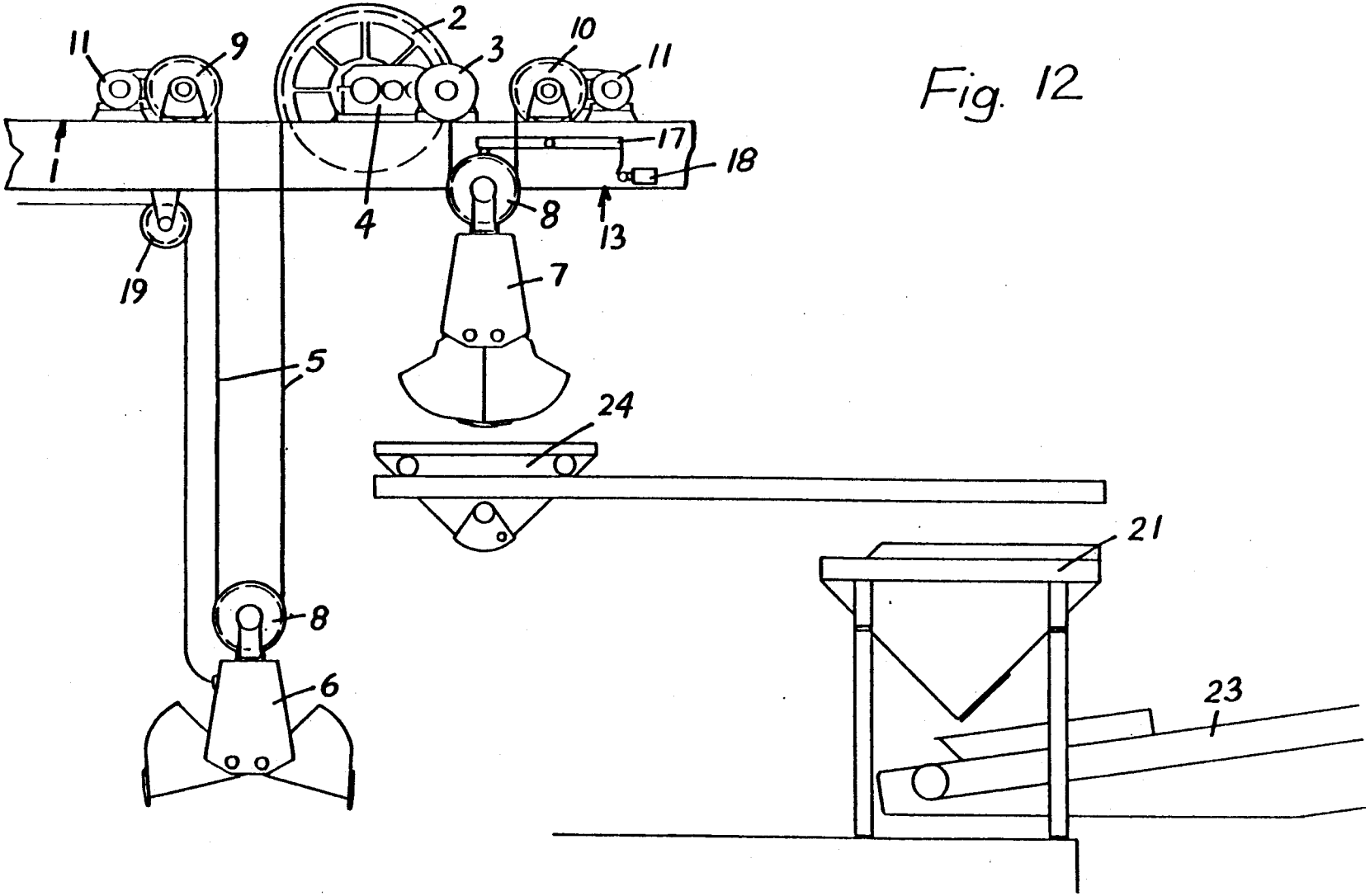
Figure 13:
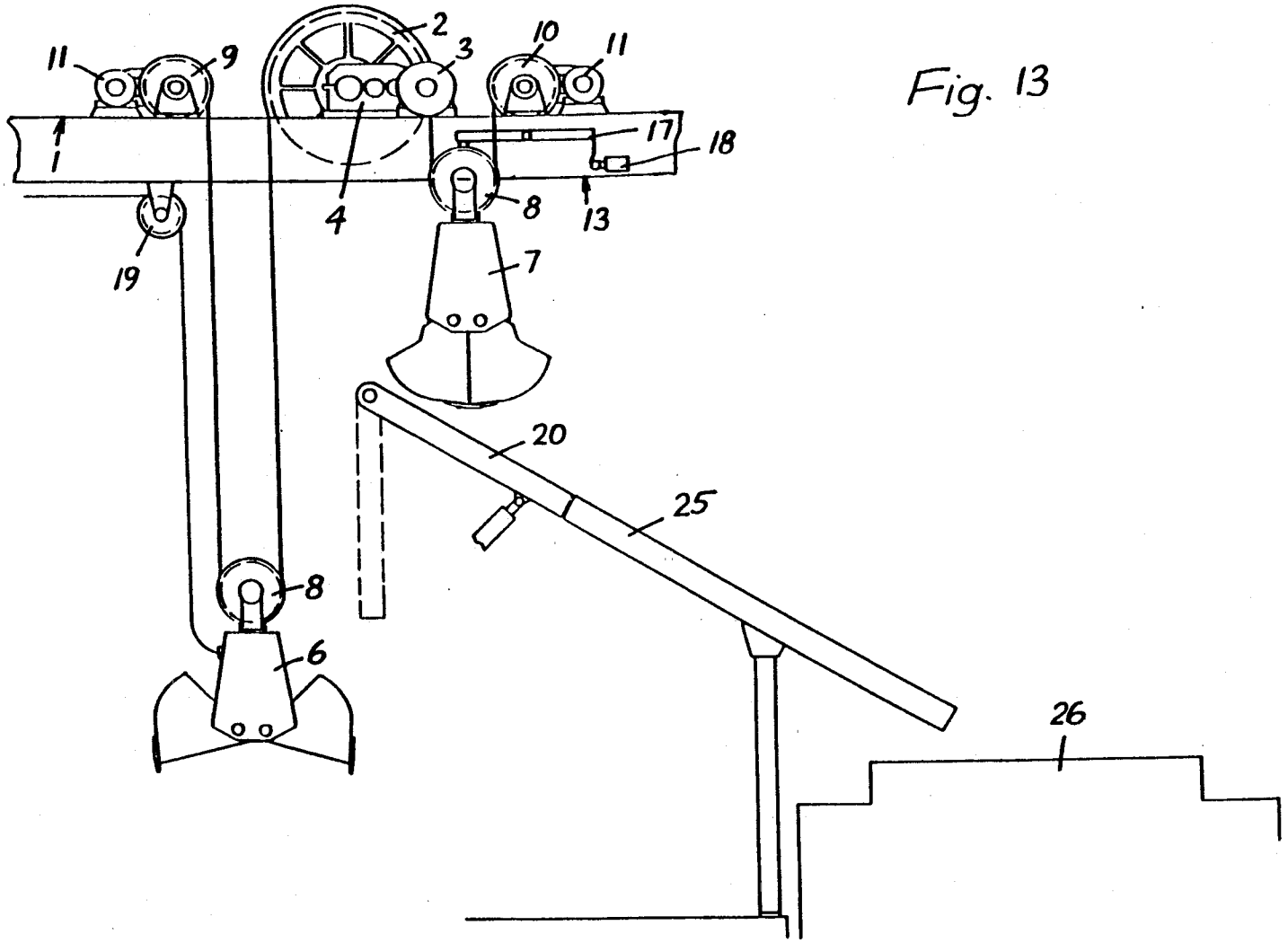
Figure 14:
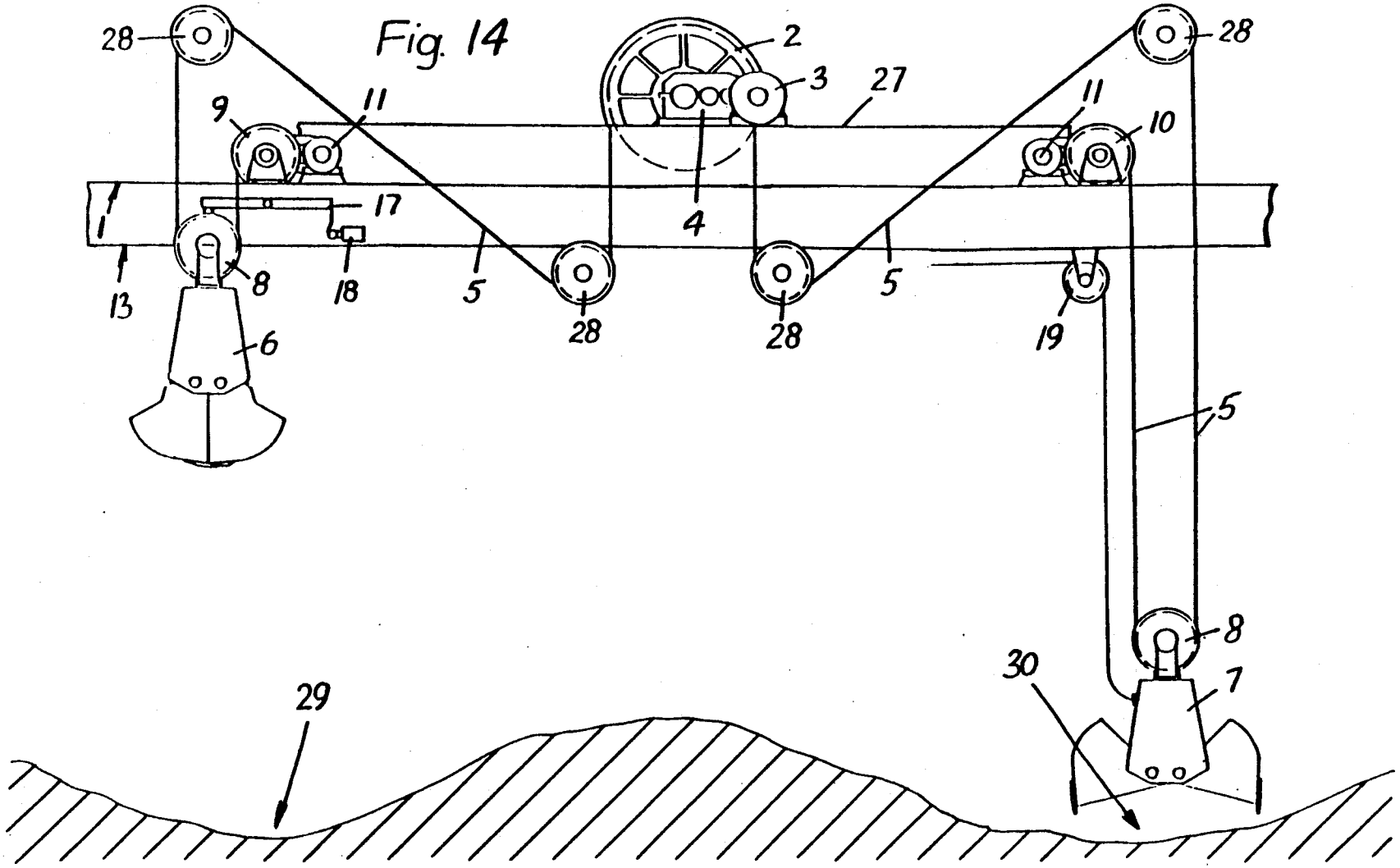
Figure 15:
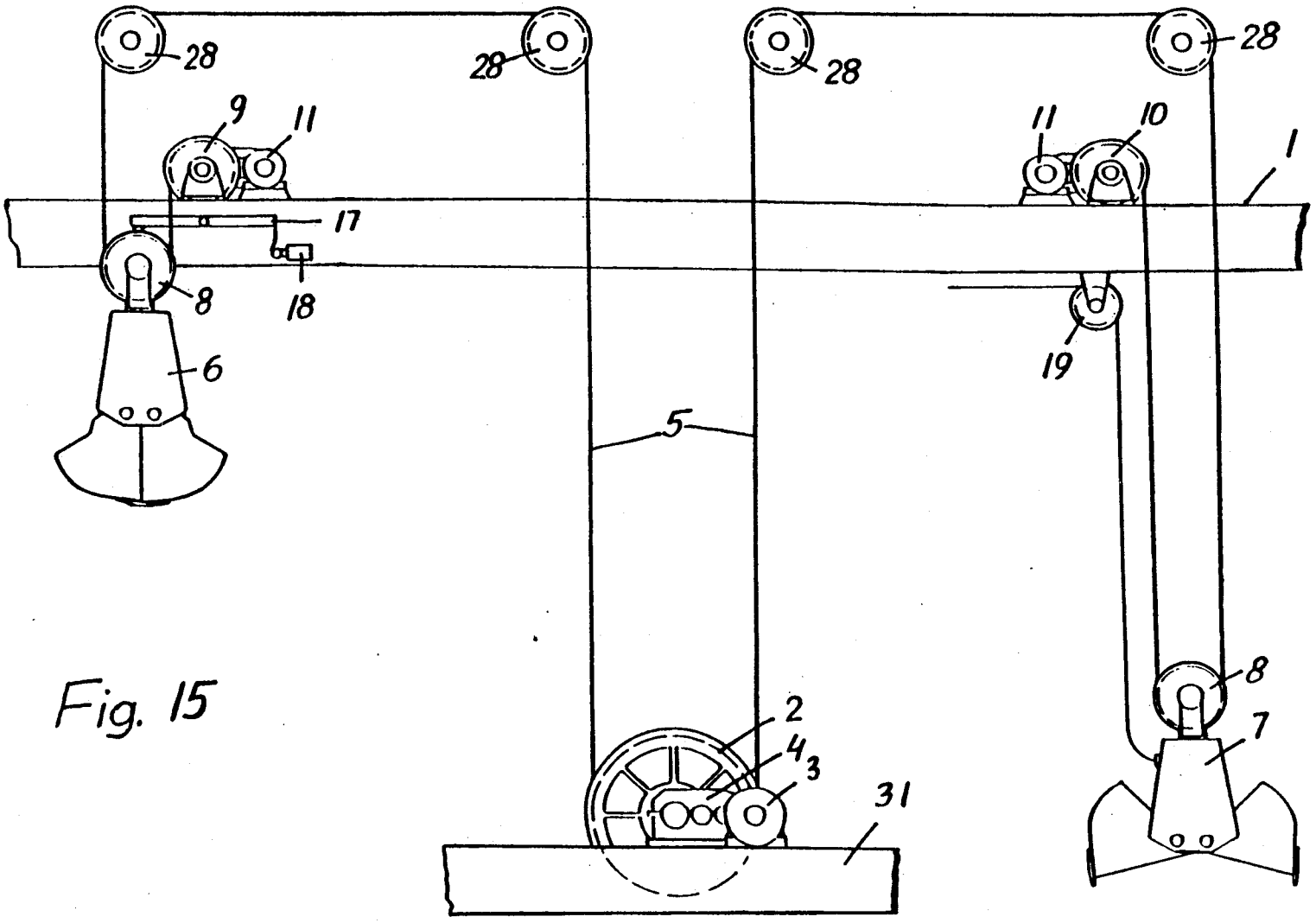

FIG. 4 a detail elevation view of the drive presenting the end points of the gripper's movements FIG. 5 a detail view showing the filled gripper in its upper end position and the open one in the water, however not yet sitting on the bottom FIG. 6 a detail showing the arrangement of the grippers when one sits on the bottom FIG. 7 a view showing the arrangement when one gripper is buried FIG. 8 illustrates another possibility for the withdrawal of a buried gripper FIG. 9 an arrangement showing control of the grippers' positions, whereby one gripper is at the discharge point and the other has not yet reached the sea bottom FIG. 10 a view showing the arrangement of the grippers whereby one touches the ground and the other is located just below its upper end position FIG. 11 a view showing the drive arrangement in conjunction with an installation for the further gravel processing FIG. 12 a view showing another arrangement for gravel removal FIG. 13 a view showing yet another arrangement for gravel removal FIG. 14 a view showing the arrangement for achieving a larger distance between the grippers FIG. 15 another execution form of the drive for a larger distance between the grippers.

The drive presented in the drawings is mounted on a floating body dredger and more specifically on a framework 1 at an adequate height over the floating body. As the main drive there is a driving pulley 2 which is driven by a motor 3 with a gear-box 4. A hoisting rope 5 runs over the driving pulley 2 designed as a rope, or a belt, pulley. The two grippers 6,7 are suspended on the rope by means of rope pulleys 8. Each rope end is fastened to a compensating winch (9, 10 - respectively) and can be wound up. During normal operations the grippers 6,7 are activated in opposing directions through the driving pulley 2. Each compensating winch is equipped with a driving motor 11 and a gear-box 12.

FIG. 3 shows an execution form or arrangement with two driving pulleys 2. Each hoisting rope 5 is passed over the gripper's suspension 8 to the compensating winches 9,10. By using several driving pulleys 2, friction and braking values are increased; we can use smaller driving pulleys and also a hoisting rope of a smaller diameter.

FIG. 4 shows the position of the grippers 6,7, in which the gripper 6 hasn't yet reached its upper end point, meaning its discharge position, yet, while gripper 7 hasn't yet reached its lower end position 14, meaning it hasn't reached entirely the sea bottom, yet. The compensating winch 10 has now the task to compensate for every change in the dredging depths, i.e. the compensating winch 10 lifts the gripper 7 until the gripper 6, assisted by the motor of the driving pulley reaches its upper end point 13. Only then the open gripper 7 settles on the ground 14 with the aid of the hoist 10, now operating in the opposite direction, and starts to grip.

FIG. 5 shows a situation whereby the gripper 7 has already reached the upper end point 13 while the opened gripper 6 is in the water, just above the sea bottom. In such a case, the compensating winch yields the hoisting rope until the gripper 6 settles on the ground and starts to grip.

FIG. 6 shows a situation whereby the gripper 7 is buried in the sea bottom 15. The gripper 6 is at its upper end point 13. No larger hoisting units are needed for the buried gripper, due to this case of overload. The drive of the driving pulley 1 can be provided just for the net hoisting operations, meaning its driving power is just sufficient for lifting operations that have small or normal power requirements. To draw out the buried gripper 7, the compensating winch 10 can be used, that operates then at a slow speed and requires correspondingly less of the installed power. According to FIG. 5, the gripper 7 is drawn out with the help of the compensating winch 10. Additionally, the drive of the driving pulley 2 can be used to increase the breakaway torque.

FIG. 7 shows an arrangement whereby the gripper 7 is buried and the gripper 6 is propped at the upper point 13 with a holder 16. Both compensating winches 9,10 can thus be used to recover the gripper 7. The breakaway torque can be additionally increased through the use of the drive of the driving pulley 2.

A further form of execution according to FIG. 8 enables the buried gripper 7 to be drawn out with the help of the other gripper 6, the latter one operating via the compensating winch 9, at a slow speed.

FIG. 9 shows a possibility to control the dredging process whereby the gripper 7 is in the upper end point 13 and the switching is effected via a lifting table (finger, lever) 17, through a contact limit switch 18. Instead of a switching arrangement of this kind, a light barrier can also be provided. The other gripper 6 is controlled by a depth switch (e.g. an initiator 9) as it reaches its lower end point. Other known switching appliances, such as weigh cells, pressure cells, wire strain gauges or standstill motor, can also be provided. Appropriate are also disconnecting devices described in DE-OS 35 36 472. The upper and lower disconnecting devices are shown in the drawings only once, but they are provided for both grippers 6,7.

In the arrangement shown in FIG. 9 the gripper 6 has not yet reached the sea bottom, so that no signal comes from the depth switch. The compensating switch 9 releases as much hoisting rope as is needed for the gripper 6 to settle and to carry out the gripping operation.

FIG. 10 shows a situation whereby the gripper 6 is already in contact with the sea bottom 14, while the gripper 7 has not yet reaches its upper end point 13. Thereby the depth switch generates the command to the compensating winch 9 to haul in the gripper 6 until the gripper 7 reaches its end position. Only thereafter can the gripper 6 commence the dredging operation. Thereby it is assured that the dead load of the grippers is eliminated throughout the haulage process. The complete drive technique can be provided with the known slip-ring rotor system, combined with programmable controlling devices, with regulated, or non-regulated, direct-current motors or, with frequency-stabilized short-circuit rotor motors. The two latter systems can also be equipped with computers, so that an accurate controlling of all movements in the work cycle is guaranteed. It is also possible to integrate sonic depth finders into the electric control system to ensure its proper functioning and control.

For the purpose of transporting the dredged gravel, it is appropriate (FIG. 11) to design a moving chute that stops below the filled gripper 7 and brings the material to a silo 21. This silo 21 can be followed by a water separator 22 that feeds the material onto the conveyor 23.

Instead of such a chute 20, a movable bunker carriage 24 can be designed that stops below the filled gripper 7 (FIG. 12) or the material can be directly loaded via chute 25 onto ships 26 (FIG. 13).

FIG. 14 shows a form of execution whereby both grippers 6,7 are arranged at a larger distance one from another. The drive of the driving pulleys 2,3,4 is here mounted on a support frame 27 and the hoisting rope 5 is put over additional guide blocks 28 this resulting in a larger distance between the grippers 6,7, that corresponds with the distance between the dredging sites 29 and 30.

The form of execution shown in FIG. 15 presents the drive of the driving pulleys 2,3,4 mounted on the floating body 31, whilst the compensating winches 9,10 are mounted on the framework 1. To achieve a larger distance between the grippers 6,7 again guide blocks 28, mounted on the framework 1, are provided.

I claim:

1. Floating dredger with one floating body (31), on which a framework (1) is arranged, said framework being provided with a hoisting unit which propels, between upper and lower limit positions, two countercurrently driven clam-shell grippers (6,7) each having their own opening and closing mechanism, said floating dredger hoisting unit having at least one driving pulley (2), a hoisting rope (5) is placed over said at least one driving pulley (2), rope pulleys (8) for each of the grippers, and the hoisting rope ends are each fastened to a compensating winch (9,10), which provides for rope compensation for varying dredging depths between said upper and lower positions.

2. Floating dredger according to claim 1, further characterized in that to increase the distance between the grippers (6,7) the hoisting rope is put over spaced idler pulleys (28).

3. Floating dredger according to claim 2, further characterized in that the driving pulley (2) is mounted on the floating body (31), while the compensating winches (9,10) and the idler pulleys (28) are mounted on the framework (1).

4. Floating dredger according to claim 1, further characterized in that means are movable under the grippers (6,7), in their upper limit positions to accept dredged material from the grippers.

* * * * *